US007674216B1

(12) United States Patent
Bolling

(10) Patent No.: US 7,674,216 B1
(45) Date of Patent: Mar. 9, 2010

(54) FITNESS APPARATUS

(76) Inventor: Todd Anthony Bolling, 8302 Lyndhurst St., Laurel, MD (US) 20724

( * ) Notice: Subject to any disclaimer, the term of this patent is extended or adjusted under 35 U.S.C. 154(b) by 0 days.

(21) Appl. No.: 12/345,083

(22) Filed: Dec. 29, 2008

(51) Int. Cl.
*A63B 26/00* (2006.01)

(52) U.S. Cl. ..... 482/142; 482/140; 446/220

(58) Field of Classification Search ..... 482/142, 482/140, 148; 446/220
See application file for complete search history.

(56) References Cited

U.S. PATENT DOCUMENTS

| | | | | | |
|---|---|---|---|---|---|
| 3,520,534 | A | * | 7/1970 | Bennett et al. | 482/77 |
| D222,091 | S | * | 9/1971 | McDermott | D21/417 |
| D223,675 | S | * | 5/1972 | Raphael | D21/417 |
| D231,790 | S | * | 6/1974 | Raphael | D21/412 |
| 4,037,833 | A | * | 7/1977 | Anderson | 472/102 |
| 5,377,625 | A | * | 1/1995 | Budman et al. | 119/709 |
| 5,810,700 | A | * | 9/1998 | Orcutt | 482/123 |
| 5,833,587 | A | | 11/1998 | Strong et al. | |
| 6,068,580 | A | * | 5/2000 | Myers et al. | 482/93 |
| D503,756 | S | | 4/2005 | Chiang | |
| 6,964,635 | B2 | * | 11/2005 | Wang | 482/109 |
| 7,060,015 | B2 | | 6/2006 | Acher | |
| 7,285,080 | B1 | * | 10/2007 | Chiu | 482/142 |
| 7,344,487 | B2 | * | 3/2008 | Carter et al. | 482/142 |
| 2008/0176727 | A1 | | 7/2008 | Heitzman | |
| 2009/0098520 | A1 | * | 4/2009 | Wilson | 434/258 |

* cited by examiner

*Primary Examiner*—Lori Baker
(74) *Attorney, Agent, or Firm*—Alfred F. Hoyte, Jr.

(57) ABSTRACT

A fitness apparatus which allows for simultaneous strength training and core muscle building/strengthening, the apparatus incorporating an inflatable exercise ball. The apparatus includes a base which allows for selectively controlling the lateral movement and compressibility of the ball while performing various exercise routines. Also incorporated in the base are adjustable resistance training devices which allow for a variety of strength training, the resistance training devices allowing routines ranging from very light to sufficiently strenuous to challenge advanced users. The apparatus is collapsible and stowable, and may be used without the exercise ball to facilitate both strength/flexibility training, as well as aerobics.

19 Claims, 8 Drawing Sheets

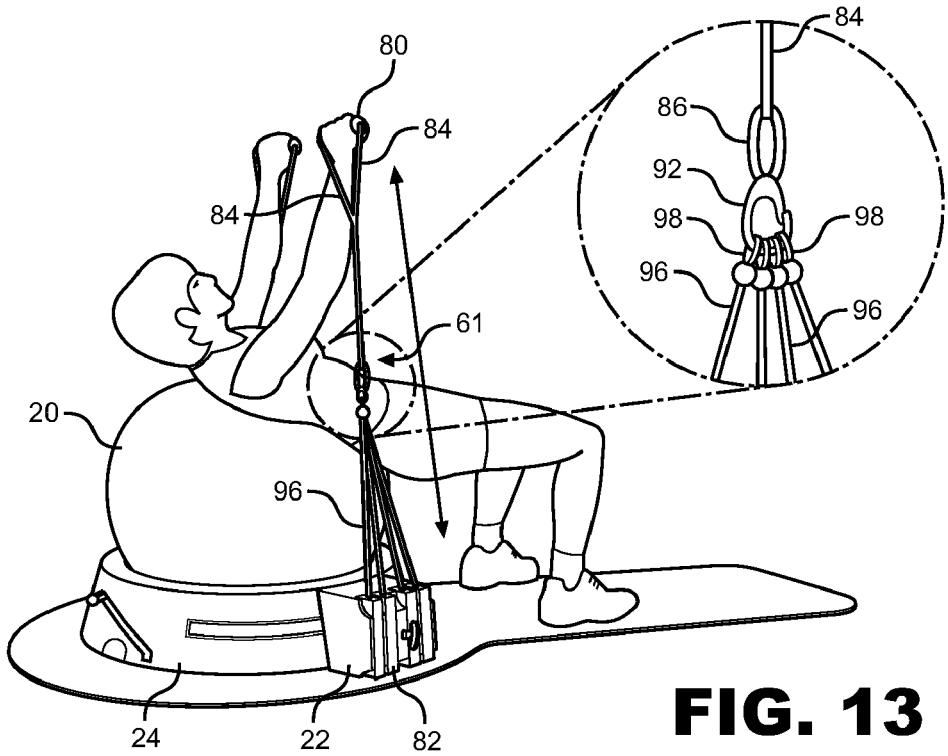
FIG. 13
FIG. 14
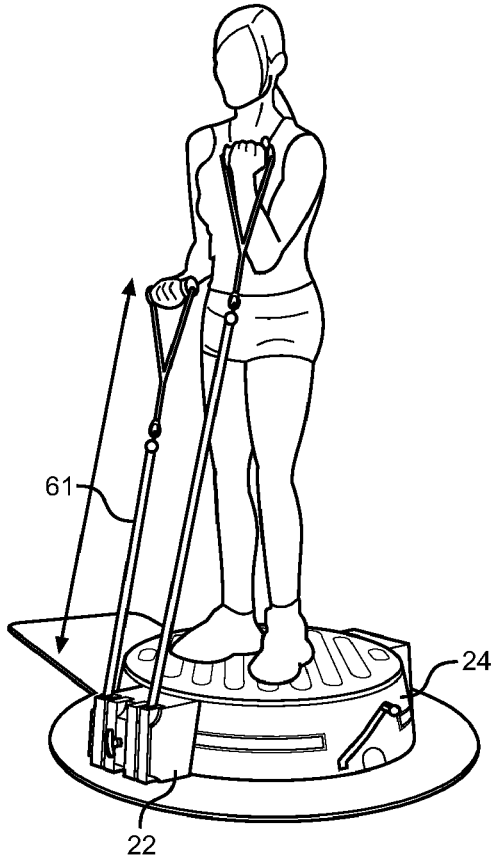

FITNESS APPARATUS

BACKGROUND OF THE INVENTION

The present invention relates to fitness apparatuses. More particularly, it relates to an improved Swiss ball or inflatable ball apparatus which includes a variable stabilizing base as well as variable resistance extension devices for working various muscle groups.

STATEMENT OF THE PRIOR ART

A Swiss ball or inflatable exercise ball is an inflatable exercise apparatus which is used primarily to promote core fitness as a way of, inter alia, increasing core (abdominal) strength and balance. The ball, being inherently unstable, is positioned between the user and a stable support surface such as a floor, the user typically having to use core muscles for stability as he performs various routines designed to isolate and target specific core muscles. The primary benefit of the exercise ball is to promote core strength and to exercise various muscle groups which are difficult or impossible to exercise using traditional weight training devices such as barbells, dumbbells, resistance training machines, and the like.

It is known to incorporate various devices in, on, or around an exercise ball to allow for the implementation of various core strengthening exercises, the resultant apparatuses including pull handles, grasping handles, and the like allowing for limited arm and leg exercises while positioned on the ball.

U.S. Design Pat. No. 503,756 issued to Chiang discloses one such device which has extended handles which apparently allow for flexibility training while positioned on the ball.

U.S. Pat. No. 7,344,487 issued to Carter et al. discloses another such device having a central bore through which a flexible, adjustable tension cord with attached grasping portions extends. U.S. Pub. App. No. 2008/0176727 issued to Heitzman discloses a frame or partial enclosure positioned around an exercise ball to restrict lateral movement of the ball while the user is positioned thereon.

The preceding devices suffer from serious drawbacks for a user attempting to achieve a full body workout or exercise regimen incorporating an exercise ball. First, the ball, being both compressible and laterally movable, presents a serious challenge to any user attempting to maintain a specific position while performing even the most routine exercises. Novice users, users engaging in physical therapy to recover from accidents or illnesses, or the elderly risk serious injury as a result from falls while attempting an exercise routine. Even more advanced users risk injury using the ball, which often requires a trainer to prevent injury from falls. The Heitzman device recognizes this problem but only provides a partial solution by providing some lateral restraint of the ball. Second, the user attempting to do a more strenuous exercise runs an even greater risk of injury both from falls and from the improper execution of specific routines as he/she attempts to maintain balance. Third, the prior art apparatuses must be used with an exercise ball. Fourth, the prior devices do not allow for varying the intensity of core building exercises. Finally, those apparatuses which do incorporate limited strength training peripherals do not allow for much variation in the applied resistance or for varying the positions from which the apparatus is used, and thus the user is limited to only a few upper body routines.

None of the above inventions and patents, taken either singly or in combination, is seen to describe the instant invention as claimed.

SUMMARY OF THE INVENTION

The present invention overcomes the disadvantages of the prior art by providing a fitness apparatus which allows for simultaneous strength training and core muscle building/strengthening, the apparatus incorporating an inflatable exercise ball. The apparatus includes a base which allows for selectively controlling the lateral movement and effective compressibility of the ball while performing various exercise routines. Also incorporated in the base are adjustable resistance training devices which allow for a variety of strength training routines, the resistance training devices allowing routines ranging from very light to sufficiently strenuous to challenge advanced users. The apparatus is collapsible and stowable, and may be used without the exercise ball to facilitate both strength/flexibility training, as well as aerobics.

Accordingly, it is a principal object of the invention to provide an improved fitness apparatus.

It is an object of the invention to provide an improved fitness apparatus which selectively incorporates an inflatable exercise ball.

It is an object of the invention to provide an improved fitness apparatus which allows for selectively restricting the lateral movement of an inflatable exercise ball.

It is an object of the invention to provide an improved fitness apparatus which allows for selectively restricting the effective compressibility of an inflatable exercise ball.

It is an object of the invention to provide an improved fitness apparatus which selectively incorporates an inflatable exercise ball in combination with adjustable, repositionable resistance training devices.

It is an object of the invention to provide an improved fitness apparatus which is reconfigurable to allow for core building, aerobics, and strength training.

It is an object of the invention to provide an improved fitness apparatus which is collapsible.

Finally, it is a general object of the invention to provide improved elements and arrangements thereof in an apparatus for the purposes described which is dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 13 shows a user positioned to perform another upper body strength training routine.

FIG. 14 shows a user positioned to perform an upper body strength routine while standing.

DETAILED DESCRIPTION

Referring now to FIGS. 1-14, the fitness apparatus of the present invention, generally indicated by the numeral 10 is shown. The apparatus 10 can be operated in four distinct but selectively overlapping modes. First, it may be operated in core building mode. It may also be operated in strength training mode, with an emphasis on core stabilizing. It may be operated in strength training mode in the same manner as a conventional resistance training apparatus. Finally, it may be operated in aerobic mode. Reconfiguring the apparatus is facilitated by the modular nature of the various components, and the apparatus 10 is collapsible and stowable as will be discussed later.

Figure 1:
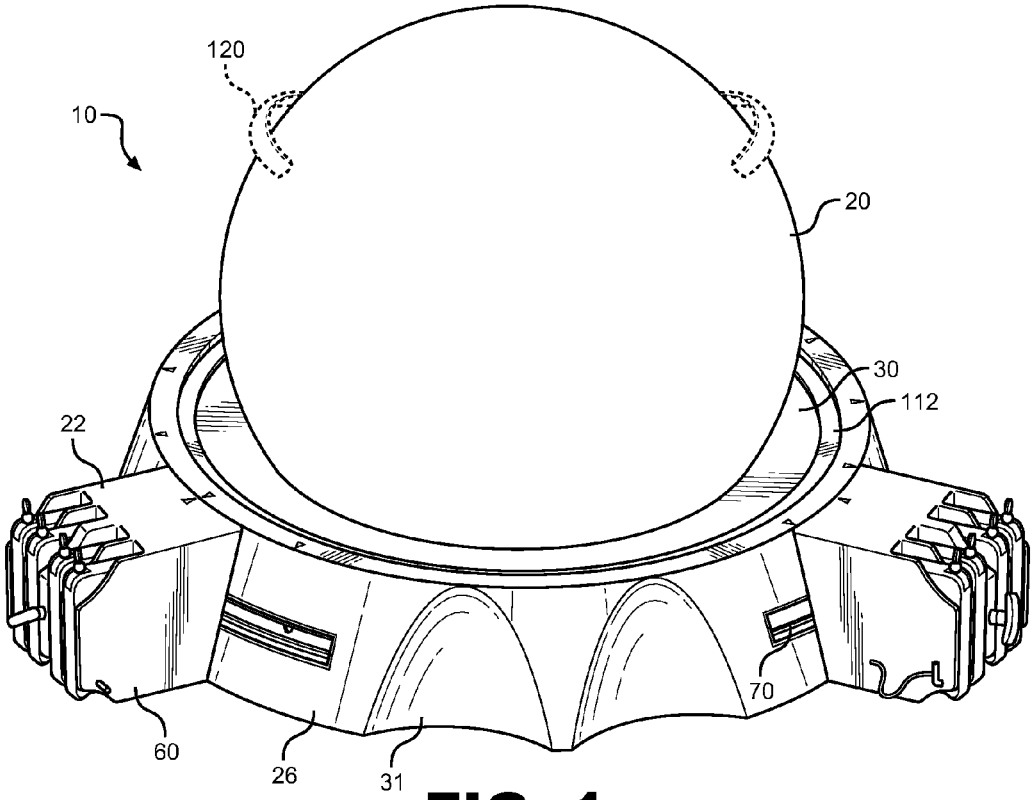
FIG. 1 shows a front perspective view of the fitness apparatus of the invention.
Figure 10:
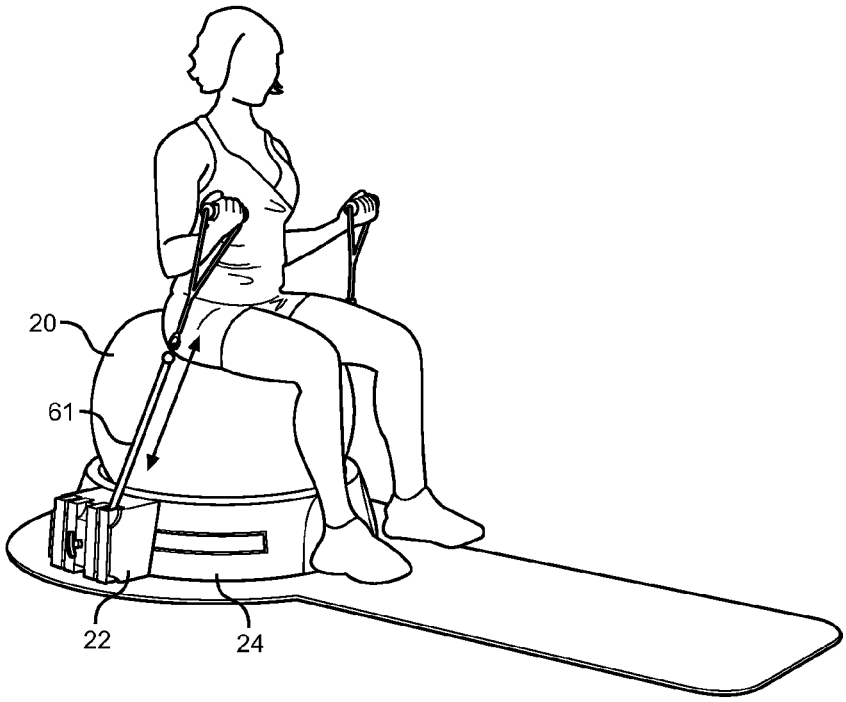
FIG. 10 shows a user positioned to perform an upper body strength training routine.

Referring now particularly to FIGS. 1 and 10, the apparatus 10 is shown with a user positioned thereon and using the apparatus in strength training mode with an emphasis on core stabilizing, that is, with the user positioned on the exercise ball 20 and operating the resistance training component 22. This is the primary mode of operation of the apparatus 10, as it affords the user many different strength training routines, all of which are amplified in varying intensity, with respect to the core muscles, by the user's position on the ball 20, and by adjustments to the stability of the ball 20 itself. It should be noted that the user may use the ball 20 in core building mode, that is, without using the various other components as described below, with the ball 20 on or off of the base 24.

Figure 2:
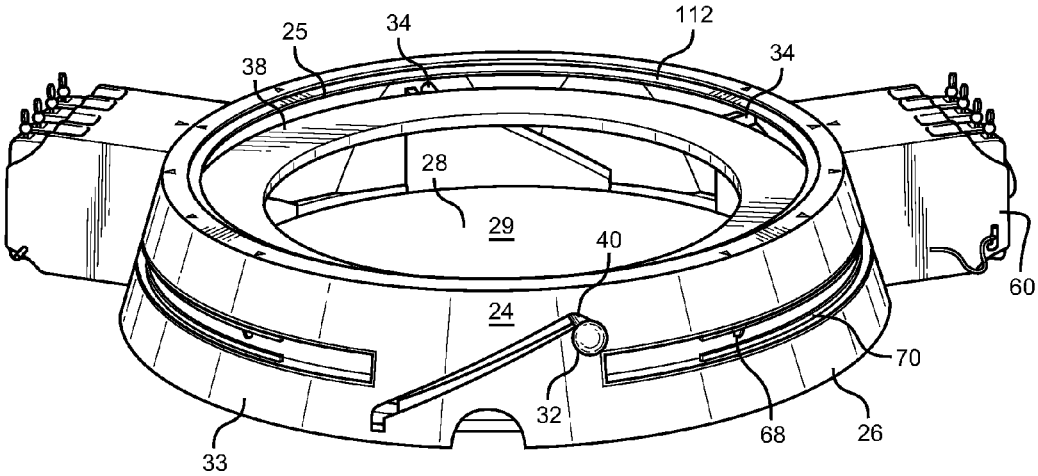
FIG. 2 shows a rear perspective view of the fitness apparatus of the invention with the exercise ball removed.
Figure 3:
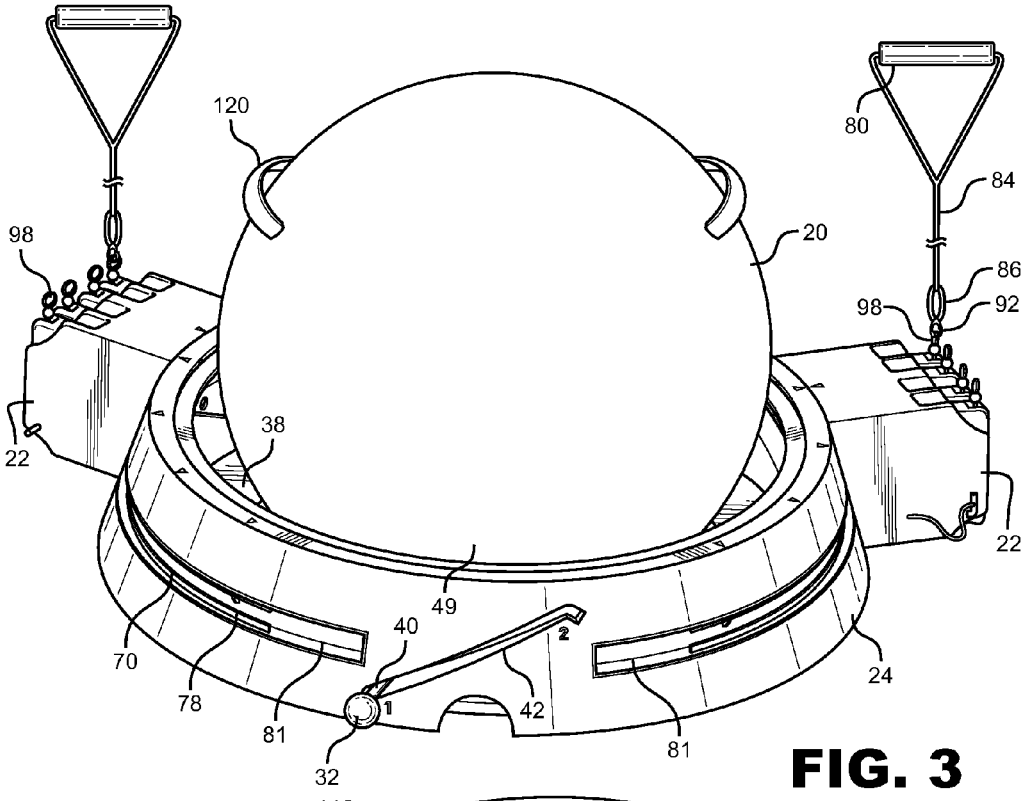
FIG. 3 shows a rear perspective view of the apparatus.

The apparatus 10 can be seen to comprise three main components. Referring now to FIG. 2 in view of FIG. 1, the three components are the base 24, which serves to contain the ball 20 and anchor the resistance training component 22 and the ball 20. The base 24 is seen to comprise a substantially frustoconical main body 26 formed of heavy plastic or other durable material and having a hollow interior 28 which forms a recess defined by a substantially continuous annular interior sidewall 25 of the main body 26 and a bottom panel 29, the main body including sloping exterior sidewalls 33, the interior wall 25 also sloped. The base 24 may be vertically adjustable using any means as may be apparent to one of skill in the art, a vertically adjustable base 24 allowing for the performance of different routines, or for performing routines from different angles. For example a mat, as shown and described below, may be folded and placed beneath the base 24. The effective depth of the interior 28 is adjustable via a ball 20 stability adjustment apparatus 30, the hollow interior 28 facilitating storage of the apparatus 10 components as will be explained in more detail later. The base 24 must be sufficiently large to allow the ball 20 a few inches, e.g. 2 to 5 inches, of lateral movement, with an adjustment mechanism 30 as described below adjustably positionable to constrict lateral movement of the ball 20. A pair of recesses 31 formed in the sloped exterior sidewalls 33 of the front portion of the base 24 allows for foot placement of the user nearer to the ball 20 while performing routines, and to ease user disengagement from the ball 20. The adjustment mechanism 30 includes an operating handle 32 which allows the user to manipulate the mechanism 30 from a high position to a low position within the base 24 to affect stability of the ball 20 within the base 24 as can be seen in FIGS. 1-3. Adjusting the mechanism 30 to a selected position within the base 24 is facilitated by several radially spaced rod-like projections 34 extending outwardly from the annular main body 38 of the mechanism 30, each of the projections 34 positioned for sliding engagement with inclined surfaces 36 of respective guide members 37. While shown as annular, the main body 38 of the adjustment mechanism 30 may be any shape which could fit about the lower end of an exercise ball 20 and restrict movement thereof. There is one guide member 37 for each projection 34, with the inclined surface 36 of each of the guide members 37 terminating at its apex with a recess 39 within which projections 34 are seated (FIG. 2) when the main body 38 of the adjustment mechanism 30 is positioned at its highest level within the base 24. Guide members 37 are securely attached to the bottom panel 29 proximate the interior sidewall 25 of the base 24. Thus it can be appreciated that the inclined surfaces 36 act as camming surfaces to translate rotational movement of the main body 38 into reciprocal movement between an upper and lower position. Handle 32 is secured to the annular main body 38 of the mechanism by a control or connecting rod 40 which extends through the sidewalls 25, 33 at the rear of the base 24 via an angular slot 42 which has a length and slope corresponding to the length and slope of inclined surfaces 36. Thus, mechanism 30 can be selectively raised or lowered by grasping handle 32 and moving it within the slot 42 between first and second positions as can be seen in FIGS. 1-3.

At the lowermost position, indicated as position 1 in FIG. 3, adjustment mechanism 30 allows for some lateral movement and compression of the ball 20 at the lower end. Specifically, it can be seen that the ball 20 can roll freely limited only by the interior sidewall 25 of the base 24, with the lower end of the ball 20 resting primarily upon the bottom panel 29. When the adjustment mechanism 30 is at the highest position, indicated as position 2 in FIG. 3, and shown with the ball 20 in place in FIG. 1, virtually no lateral movement of the ball 20 is allowed as the annular main body 38 of the adjustment mechanism 30 confines and restricts lateral movement of the ball 20, and deformation at the lower end 49 of the ball 20 is greatly restricted. To the user, the ball 20 is thus relatively stable when the adjustment mechanism 30 is at the highest level, effectively reducing the amount of effort required by the user to stabilize her position on the ball 20, the result being a comparatively reduced core workout. The user may then progress to a more difficult core routine by adjusting (lowering) the vertical position of the adjustment mechanism 30.

A key aspect of the invention is to allow for selectively restricting the lateral translation and effective compressibility of the ball 20 in order to allow for varying the intensity of the core workout. As previously mentioned, an exercise ball 20 effectively strengthens core muscles by forcing the user to balance herself on the ball while performing an exercise routine. The need to maintain balance is a direct result of the fact that the ball 20 is inherently unstable, rolling and compressing with even the slightest shift in the user's balance. Therefore, the less the ball 20 rolls and compresses, the less the user must "recruit" core muscles to maintain his position on the ball 20. Accordingly, with the handle 32, and therefore the adjustment mechanism 30 at the highest position, indicated by the numeral 2 in FIG. 9 and shown in FIGS. 1 and 2, the mechanism 30 affords maximum stability of the ball 20, effectively reducing the intensity of the core workout for any routine done on the ball 20. With the handle 32 at the lowest position, indicated by the numeral 1 in FIG. 9 and shown in FIGS. 3, 5, and 9, there is a corresponding increase in core workout intensity as the ball 20 is allowed to compress and roll within the limits as discussed above. It should be noted that the adjustment mechanism 30 may be configured to allow for infinite adjustment, or to allow for stepped increments by providing additional recesses 39, or by other modification as would be apparent to one of skill in the art. Also, the annular main body 38 and the base 24 are sized in accordance with the size of the ball 20. The inner surface of the main body 38 should be sized so that only about $\frac{1}{8}^{th}$ to $\frac{1}{4}^{th}$ of the ball 20 can fit through to ensure that the ball 20 is seated firmly within the main body 38 and cannot move laterally. The base 24, adjustment mechanism 30, and resistance component 22, as well as all subcomponents may be made of any rigid durable material such as hard plastic, except as otherwise indicated.

Figure 6:
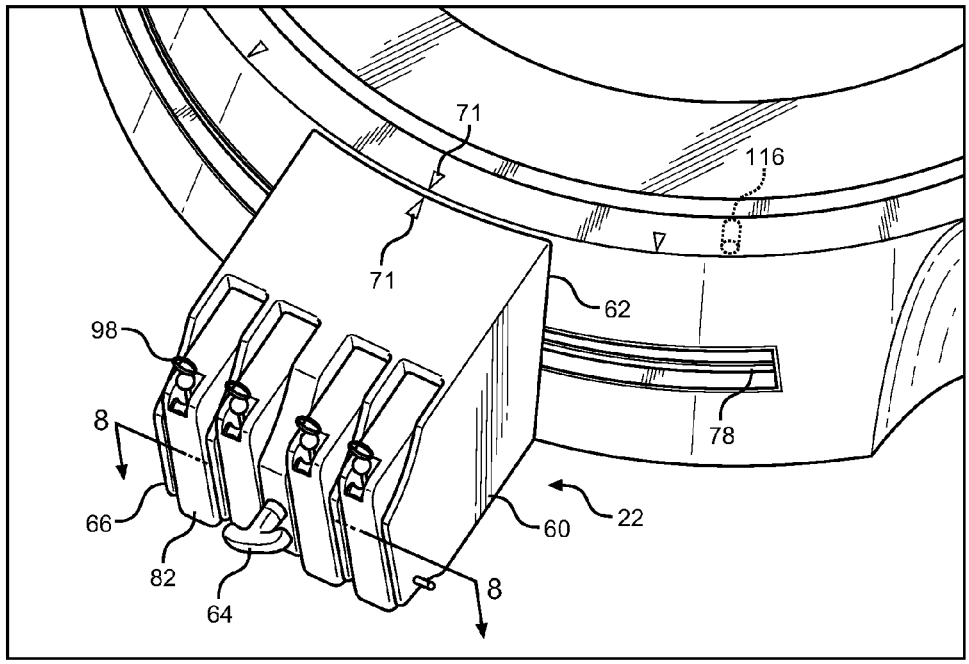
FIG. 6 shows a perspective view of the housing for the resistance training component.
Figure 7A:
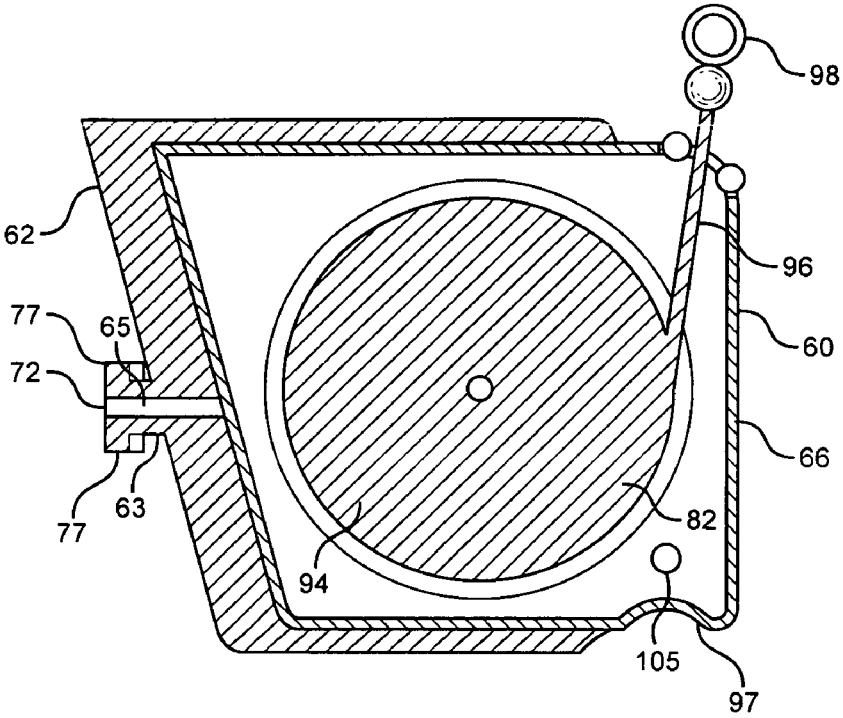
FIG. 7A shows a side sectional view of the housing for the resistance training component.
Figure 7B:
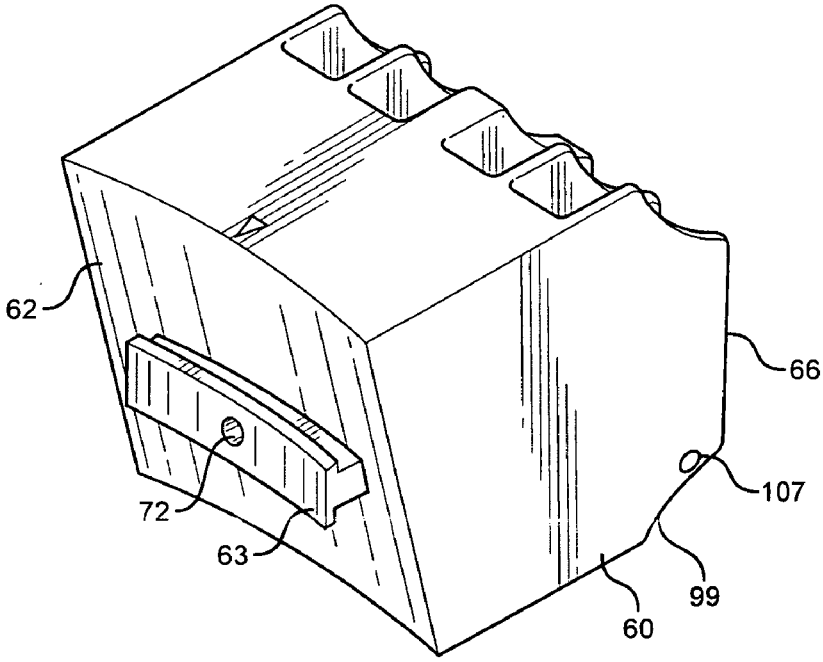
FIG. 7B shows a rear perspective view of the housing for the resistance training component.
Figure 8:
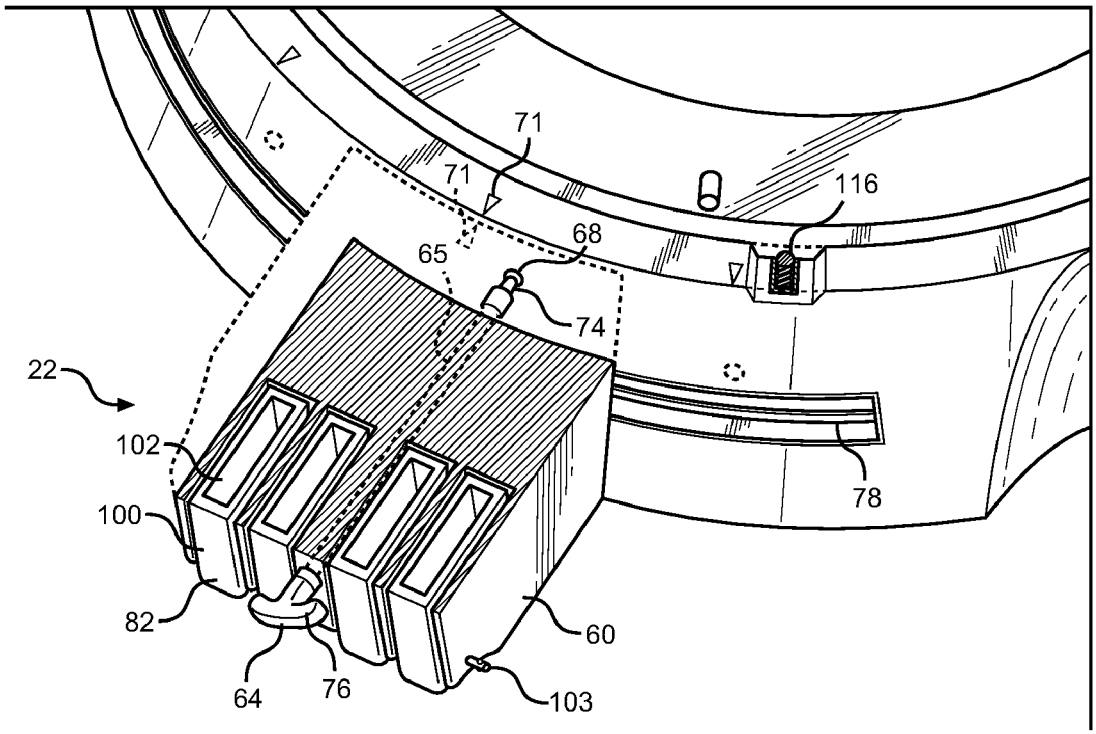
FIG. 8 shows a top sectional view of the housing viewed from line 8-8 of FIG. 6 for the resistance training component.
Figure 9:
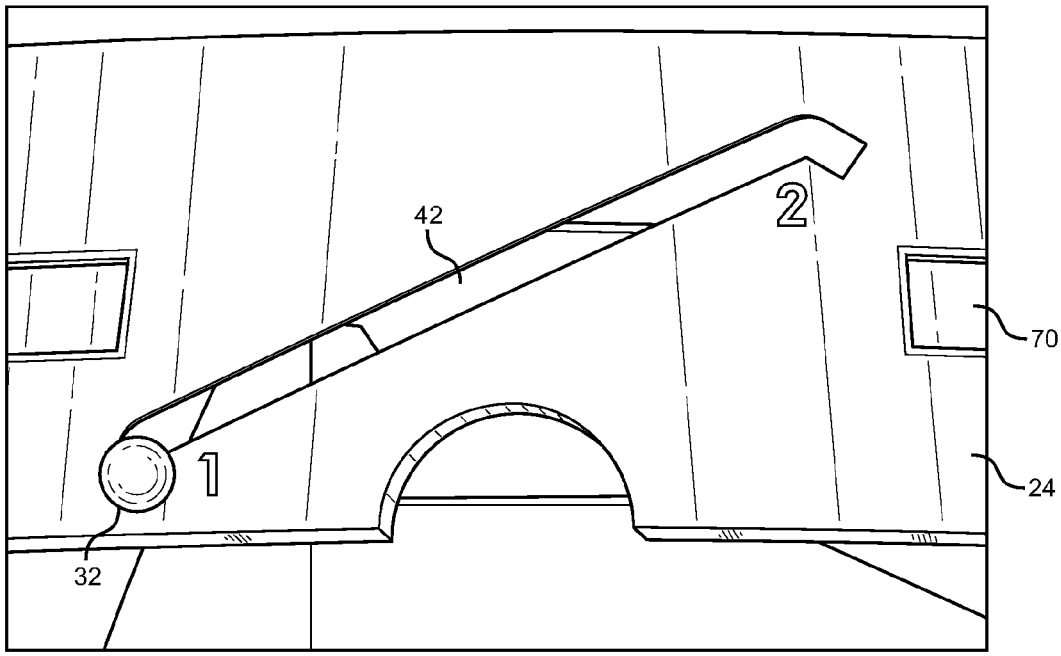
FIG. 9 shows a detail of the control rod of the ball stability adjustment mechanism.

Referring now particularly to FIGS. 6-8, the resistance training component 22 can be seen. At least two resistance components 22 are preferably provided, but more may be provided as necessary. A single resistance component 22 may be provided and used as described in detail below. Each resistance component 22 comprises a removable housing 60, the housing 60 having an angled and contoured rear face 62 corresponding to the slope and contour of the exterior wall 33 of the base 20 to enable a flush engagement therewith. Extending from the rear face 62 is an elongated guide 63 which is sized for sliding engagement within a track 70 formed in the exterior wall 33.

A removable, spring loaded "pin" or connecting member 64 extends laterally through a bore 65 formed in the housing 60 from the front face 66 to the rear face 62, the bore 65 terminating in an aperture 72. The pin 64 is sized for insertion into one of a series of apertures 68 formed in the track 70, the connecting member 64 in combination with angled rear face 62 and guide 63 serving to secure the housing 60 to the base 24. The apertures 68 are formed in circumferential spaced relation within the track 70 to allow for repositioning of the components 22 as necessary to facilitate a full range of motion for a particular exercise routine. Indicia such as opposing arrows 71 or the like may be imprinted on the housing 60 and at points along the upper edge of the base 24 corresponding to the positions of the apertures 68 to allow for proper user alignment. The tip of the pin 64 is a spring loaded extension 74 biased in the extended position. Rotation of the pin 64 by grasping and twisting tab 76 causes retraction of the extension 74 within aperture 72, disengaging the pin 64 from the aperture 68 allowing the component 22 to slide along track 70. Repositioning of the component 22 is accomplished by twisting tab 76 until the extension is disengaged from the aperture 68, sliding the component 22 along track 70 until arrow 71 imprinted thereon is aligned with a selected arrow 71 imprinted on the base 24, and releasing the tab 76 allowing the extension 74 to engage within the selected aperture 68. This type of pin or connecting member 64 is well known in the art. Guide member 63 has opposing flanges 77 which are sized for sliding engagement within grooves 78 formed in the track 70, the grooves 78 extending along the track 70 from the front end 79 of the track 70, terminating proximate the rear end 81. The housing 60 may be disengaged from the track 70 at the point 81 where the grooves 78 terminate.

An extension element 61 (see especially FIG. 13 detail) is operatively connected within the housing 60 to allow for variable resistance strength routines. Each extension element 61 comprises a handle 80 selectively connectable to an array of resistance members 82 positioned within housing 60. A pair of connecting straps 84 extends from opposing ends of the handle 80, the straps 84 joined together and connected to an elongated loop 86 made of durable material such as metal. A clasp or other releasable connector 92 (e.g., a lobster clasp) is connected to loop 86, the clasp 92 sufficiently large to connect to any or all of the pull rings 98 which are connected to a length of extension cable 96 which is contained within the resistance members 82.

Resistance members 82, of which there are may be one or more, but preferably at least two, may be spring reels 94 formed of a length of extension cable 96 terminating in pull ring 98, the cable 96 wrapped around a groove formed in the reel 94, which reels 94 are biased to retract the cable 96 by a coil spring as is well known in the art. The reels 94 may be conventional arbor reels encased in plastic cartridges, which may vary in effective resistance from about 5 pounds effective resistance up to 50 pounds or more. The resistance of the resistance member 82 is determined by, e.g., the spring constant of the spring (not shown) within the resistance member 82. The force/work required to extend the handle 80 to the limit of travel provided by the cable 96, can be varied from a few pounds up to 40 or 50 pounds or more. Accordingly, the resistance components 22 can be provided for users of all strength levels, with an array of light, medium, or heavy resistances available for each component 22. Thus, for a user requiring a light resistance, a component 22 having four resistance members 82 offering resistance of 5, 7.5, 10, and 15 pounds may be provided. For a user requiring a more strenuous workout, the resistance members 80 may provide a resistance of, for example, 20, 30, 40, and 50 pounds. Of course, more or fewer resistance members 82 may be provided within housing 60 than the four shown, with four being optimal as it affords the user some flexibility and keeps the size and weight of the component 22 at a minimum to allow for enhanced portability.

Each of the resistance members 82 are self contained cartridges 100 which slide into slots 102 provided in housing 60. The cartridges 100, which have a substantially rectangular geometry, with a sloped rearward portion corresponding to the slope of the base 24, may be made of hard plastic or other durable material. A pin 103, which may be a conventional pin having a tip with ball plungers as used with weight plates, extends horizontally through housing 60 and cartridges 100, preventing unintended disengagement of the cartridge 100 due to torque loading as an exercise routine is performed. Apertures 105, 107 formed in cartridges 100 and the lower end of the housing 60 respectively, are axially aligned when the cartridges 100 are properly seated within the housing 60. Both the housing 60 and cartridges 100 have forward grasping areas 97, 99 respectively to provide space for hand placement as the housing 60 rests primarily upon the floor which would otherwise interfere with manipulation of the housing 60 and cartridges 100. The clasps 92 appended to the connecting straps 84 allow for selective engagement with the pull ring 98 of the resistance member 82 to allow the user flexibility with respect to the effective resistance provided to each extension member 61. Thus, from the example above, the user may select cartridges 100 having a resistance of 5 and 7.5 pounds for an effective resistance of 12.5 pounds. With effective resistance member 82 resistances as discussed above then, the user may select from an effective resistance of between 5 and 37.5 pounds. If the cartridges 100 ranged from 10 to 50 pounds, the user could select from between 10 and 120 pounds effective resistance. Of course, the clasps 92 can be arranged to allow for simultaneous engagement with as many of the four pull rings 98 as desired. The apparatus 10 would be packaged with several cartridges 100 to allow for routines to be performed by users of all strength levels. The apparatus 10 thus provides for variable resistance training regimens by interchanging (replacing) cartridges 100 or by selectively attaching to cartridges 100 already in place.

Figure 4:
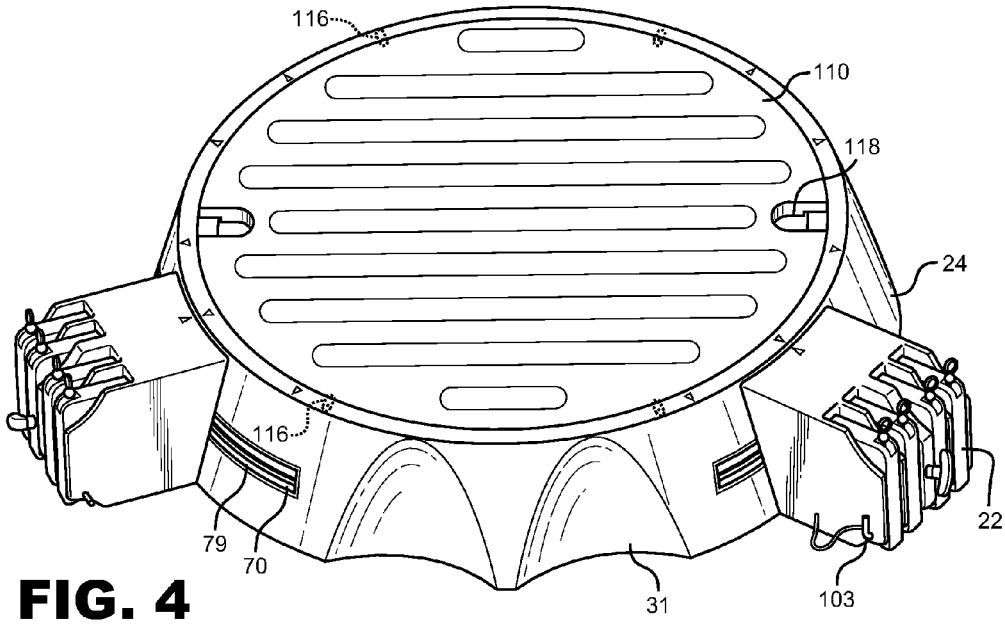
FIG. 4 shows a rear perspective view of the apparatus illustrating an alternative operational mode of the apparatus.
Figure 5:
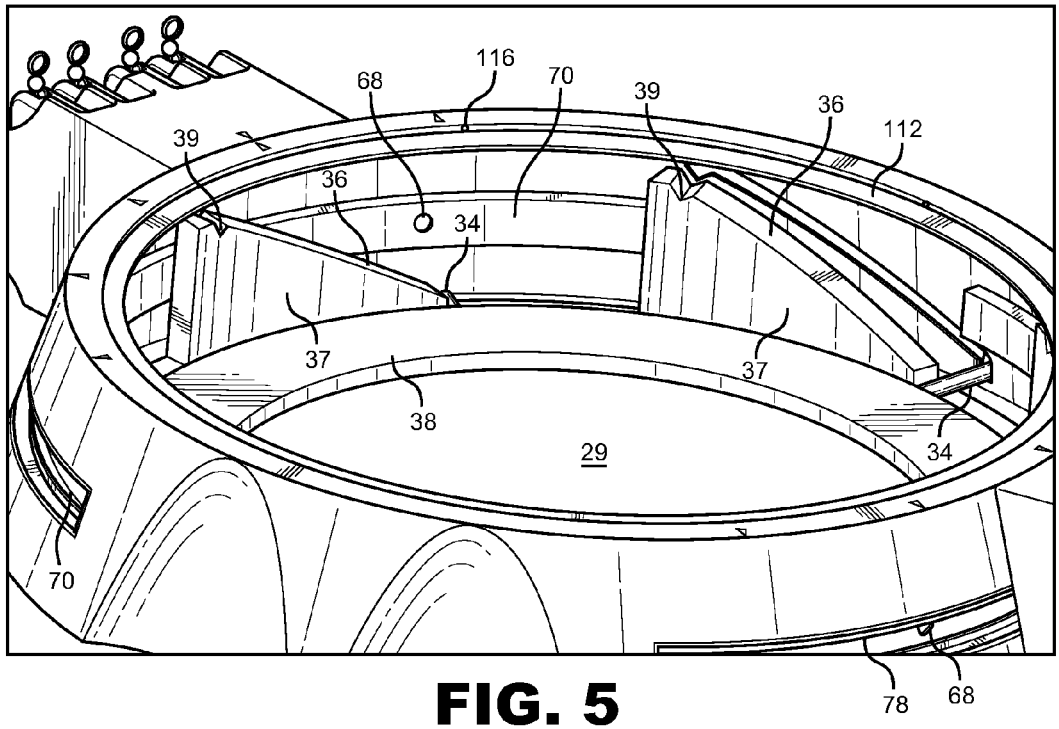
FIG. 5 shows a perspective view of the interior of the base component of the apparatus illustrating the ball stability adjustment mechanism.

FIG. 4 shows the apparatus 10 reconfigured as an aerobic stepper. In this configuration, the user may step onto platform 110 which is held in place by a recessed annular shelf 112 formed in the upper portion of the base 24. Platform 110 is essentially a rigid panel which may be formed of the same material as the base 24, and may include friction material adhered thereto or formed integrally therefrom as by molding a roughened area. The platform 110 is held down by a locking mechanism such as a plurality of radially spaced ball plungers 116 formed in the base 24 proximate the shelf 112. The ball plungers 116 allow for a snap fit engagement of the platform 110 within the shelf 112, reducing the possibility of rotational or unintended displacement of the platform 110. U-shaped cutouts 118 in the platform 110 allow for grasping and removal of the platform 110.

The ball 20 may be a standard exercise ball, inflatable and made from a resilient material such as rubber, and commonly sold as a Swiss ball made of rubber or plastic and sufficiently durable to withstand several hundred pounds of pressure. The ball 20 would preferably have handles 120, the handles 120 preferably being of a unitary construction to reduce the possibility of unintended detachment, although any means of securely attaching the handles 120 may be employed. A ball 20 of about 26 inches in diameter may be used, but larger or smaller balls may be used, with the size of the base 24 made in accordance with the size of the ball 20. The handles 120 are spaced to allow the user to support himself thereon while performing the routines as described in more detail below. Specifically, the handles 120 should be spaced slightly more than shoulder width, allowing the user to extend their hands from their core for balance or additional support. Thus handles 120 should be placed on opposing sides of the upper half of the ball 20, the term upper half being relative with respect to the orientation of the ball 20 on the base 24 or a floor. Multiple handles 120 may also be positioned on the ball 20. With handles 120 on the ball 20 as shown and discussed, the ball 20 may be used in standalone mode, with the handles 120 used to facilitate certain routines such as leg extensions or any routine where the uses positions her hands on the ball 20.

As previously stated, the apparatus 10 may be used in several modes. In a first mode the user is positioned on the ball 20 performing various routines. In a second mode, the user may stand on the base with the platform 110 secured in position on the base 24 and perform resistance training routines. In a third mode, the user may use the platform 110 secured on the base 24 as an aerobic step. Referring again to FIG. 10, a user is shown positioned on the ball 20 performing a resistance training routine. The particular routine shown is a resistance training routine focusing primarily on the upper body and core muscles. Once the user has set the adjustment mechanism 30 as described, and attached the extension element 61 to a selected one of the resistance members 82, a curling routine may be performed. Unlike traditional curling routines, the user must recruit core muscles in order to remain stably positioned on the ball 20 and perform the exercise using the proper form, i.e. pulling the extension element 61 via handle 80 upwards to the maximum extension possible, and releasing the extension member 61 downwards, with both upward and downward movement performed against the resistance provided by the resistance member 82. The resistance training component 22 may be repositioned as desired in order to emphasize biceps primarily, i.e., by moving both resistance components 22 forward near the front (foot position 31) as would be apparent to one familiar to resistance training apparatuses.

Figure 11:
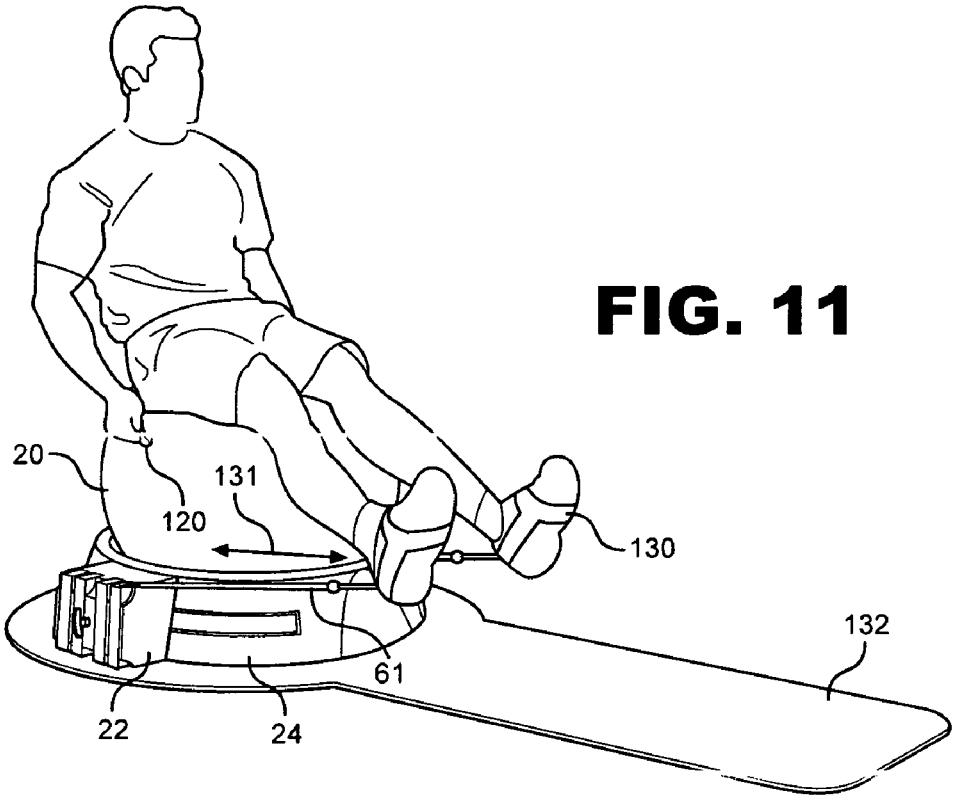
FIG. 11 shows a user positioned to perform a lower body strength training routine.

FIG. 11 shows a user performing a leg extension routine. It can be seen that this routine requires a foot holder or harness 130 be used in place of handle 80 on extension member 61, the foot harness 130 being a conventional design used with resistance training devices. The user may grasp handles 120, spaced as described above, for additional stability, while extending and retracting his legs as shown by arrow 131. A mat 132 having a circular end portion corresponding to the size and shape of the base 24, and an elongated forward extension may be placed under the base 24 to protect the primary support surface (i.e., the floor) from, e.g., scuff damage.

Figure 12:
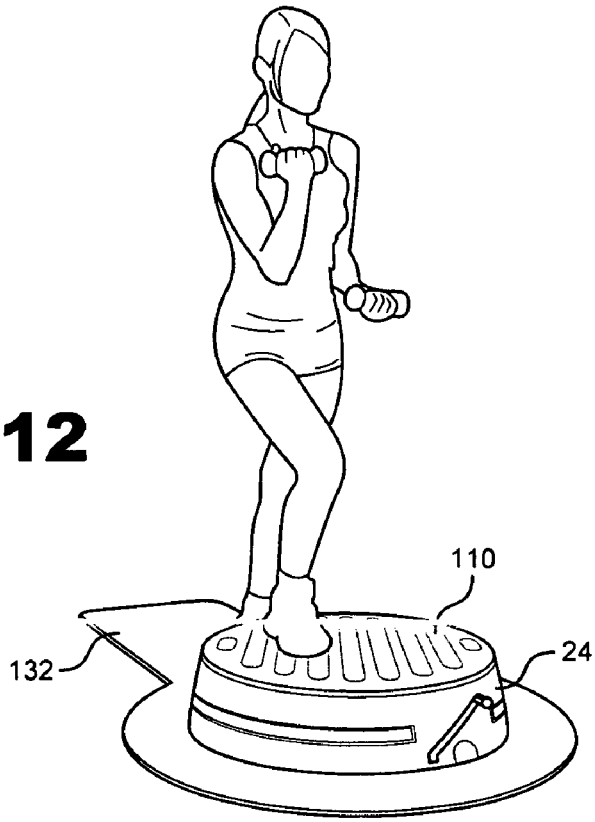
FIG. 12 shows a user positioned to perform an aerobic training routine.

FIG. 12 shows a user performing an aerobic stepping routine. The resistance training components 22 may be removed and stored in the interior 28 of the base while performing this routine, as may the mat 132 for storage of the apparatus 10. The base 24 has sufficient volume to contain a deflated ball 20 so that the apparatus 10 may be broken down and stowed or transported as a single unit.

FIG. 13 shows a user performing an upper body routine, specifically, a bench press routine performed lying on the ball 20 and extending and retracting the arms as shown. The routine is intensified by the instability of the ball 20, less so when the adjustment mechanism 30 is positioned in the upper position as discussed. The user may adjust the weight by either attaching the clasp 92 to, for example, only one or two of the rings, or by replacing the cartridges 100 as desired to achieve a desired effective resistance.

FIG. 14 shows a user performing a curling routine standing on the platform 110. In this configuration, the apparatus functions as a standard resistance apparatus. It can be seen that only a single resistance component 22 is used with 2 pull handles attached, allowing for closer spacing of the hands.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A fitness apparatus comprising:

a base, said base including an interior sidewall and a bottom panel, said sidewall and bottom panel defining a recess within said base;

an inflatable exercise ball including upper and lower portions, said lower portion removably positioned within said recess;

an adjustment mechanism positioned within said recess to engage the lower portion of said ball, said mechanism connected to a handle, said adjustment mechanism selectively adjustable about the lower portion of the ball by manipulation of said handle.

2. The apparatus of claim 1 wherein said base has a main body, said main body including exterior sidewalls with at least one bore formed therein;

at least one resistance component including a housing, the housing including an attachment member sized for insertion into and through said housing and said at least one bore to attach said housing to said base, the housing containing at least one resistance member, said at least one resistance member having a pull handle attached thereto.

3. The apparatus of claim 1 wherein said main body includes an angled slot formed therethrough and said adjustment mechanism handle includes a connecting rod extending through said slot and connected to said adjustment mechanism, whereby said adjustment mechanism may be selectively raised or lowered by manipulation of said handle.

4. The apparatus of claim 3 wherein said adjustment mechanism has an annular main body vertically displaceable in discrete increments to selectively restrict or allow compression and lateral translation of said ball.

5. The apparatus of claim 2 wherein said at least one resistance component includes a foot harness operatively and removably attached thereto.

6. The apparatus of claim 1 wherein said ball includes a pair of handles positioned thereon.

7. The apparatus of claim 6 wherein said handles are disposed in spaced relation on the upper portion of said ball.

8. The apparatus of claim 1 wherein said base is vertically adjustable.

9. The apparatus of claim 2 wherein said resistance component housing contains at least one resistance member, said at least one resistance member contained within a cartridge adapted for releasable engagement within a slot formed in the housing.

10. The apparatus of claim 1 including a mat intermediate said base and a primary support surface.

11. The apparatus of claim 1 wherein a platform is releasably attachable in weight hearing relation within an upper portion of said base when said ball is removed from said base.

12. The apparatus of claim 1 wherein said resistance component housing is releasably attached to said base.

13. The apparatus of claim 2 wherein said resistance component, said ball, and said mat are stowable within said base with said platform attached to the base.

14. The apparatus of claim 9 wherein said pull handle is selectively attachable to said at least one resistance member.

15. The apparatus of claim 2 wherein said resistance component housing is slidably attached to said base, whereby said housing may be selectively anchored at discrete positions along said exterior sidewall of said base.

16. A fitness apparatus comprising:

A base, said base having an interior sidewall and a bottom panel defining a recess, said main body including exterior sidewalls with an annular track positioned within said sidewalls, said track having a series of bores formed therein;

an inflatable exercise ball having upper and lower portions and, said lower portion removably and adjustably positioned within said recess;

an adjustment mechanism positioned within said recess to engage the lower portion of said ball to adjustably restrict lateral movement and compression of said ball, said adjustment mechanism having a handle connected thereto; and, a pair of resistance components, each of said components including a housing having an attachment member sized for insertion into and through said housing and one of said bores to secure said housing at a selected position on said track, the housing containing at least one resistance member, said at least one resistance member including a pull handle attached thereto.

17. The apparatus of claim 16 wherein said main body has an angled slot formed therethrough and said adjustment mechanism includes a handle includes a connecting rod extending through said slot and connected to said adjustment mechanism, whereby said adjustment mechanism may be selectively raised or lowered by manipulation of said handle.

18. The apparatus of claim 16 wherein said adjustment mechanism has an annular main body which is vertically displaceable in discrete increments to selectively restrict or allow compression and lateral translation of said ball.

19. The fitness apparatus of claim 2 including several resistance members contained within said resistance component, and wherein said pull handle is selectively attachable to any one or several of said resistance members.

* * * * *